US008575869B2

(12) United States Patent
Kallioniemi et al.

(10) Patent No.: US 8,575,869 B2
(45) Date of Patent: Nov. 5, 2013

(54) ARRANGEMENT AND METHOD IN CONNECTION WITH A TRANSPORT SYSTEM

(75) Inventors: Antti Kallioniemi, Jokela (FI); Esko Aulanko, Kerava (FI)

(73) Assignee: Kone Corporation, Helsinki (FI)

( * ) Notice: Subject to any disclaimer, the term of this patent is extended or adjusted under 35 U.S.C. 154(b) by 49 days.

(21) Appl. No.: 12/985,126

(22) Filed: Jan. 5, 2011

(65) Prior Publication Data

US 2012/0010751 A1 Jan. 12, 2012

Related U.S. Application Data

(63) Continuation of application No. PCT/FI2009/050506, filed on Jun. 12, 2009.

(30) Foreign Application Priority Data

Aug. 1, 2008 (FI) ..... 20080450

(51) Int. Cl.
*H02P 1/54* (2006.01)
*H02P 5/00* (2006.01)
*H02P 5/46* (2006.01)

(52) U.S. Cl.
USPC ..... 318/106; 318/107; 318/376; 187/276; 187/289; 187/290; 180/65.21

(58) Field of Classification Search
USPC ..... 318/106, 107, 376; 187/276, 289, 290; 180/65.21
See application file for complete search history.

(56) References Cited

U.S. PATENT DOCUMENTS

| | | | | |
|---|---|---|---|---|
| 4,554,999 | A * | 11/1985 | Kamaike | 187/290 |
| 6,315,081 | B1 | 11/2001 | Yeo | |
| 6,422,351 | B2 * | 7/2002 | Tajima et al. | 187/290 |
| 6,460,658 | B2 * | 10/2002 | Suga et al. | 187/290 |
| 6,742,630 | B2 | 6/2004 | Eilinger | |
| 6,827,182 | B2 * | 12/2004 | Araki | 187/290 |
| 6,938,733 | B2 * | 9/2005 | Eilinger | 187/290 |
| 2001/0013447 | A1 | 8/2001 | Araki et al. | |
| 2001/0017239 | A1 | 8/2001 | Tajima et al. | |

FOREIGN PATENT DOCUMENTS

| | | | |
|---|---|---|---|
| JP | 11-217166 | A | 8/1999 |
| JP | 2005-102410 | A | 4/2005 |
| WO | WO 2006/099318 | A1 | 9/2006 |

* cited by examiner

*Primary Examiner* — Erick Glass
(74) *Attorney, Agent, or Firm* — Birch, Stewart, Kolasch & Birch, LLP

(57) ABSTRACT

A transport system includes a motor for moving the transport appliance and a power supply circuit of the motor. The power supply circuit is connected between the motor and a power source that is limited ($P_{lim}$) in its dimensioning. An energy storage that is limited ($E_{lim}$) in its capacity is fitted in connection with the power supply circuit of the motor. The control arrangement includes a determination of the charging status (EQ) of the energy storage; a determination of the movement reference of the transport appliance; and a control of the movement of the transport appliance as a response to the determined movement reference of the transport appliance. The movement reference of the transport appliance is determined on the basis of the amount of energy that can be discharged from the energy storage and/or on the basis of the amount of energy that can be charged into the energy storage as well as on the basis of the travel distance of the transport appliance.

15 Claims, 4 Drawing Sheets

ARRANGEMENT AND METHOD IN CONNECTION WITH A TRANSPORT SYSTEM

This application is a continuation of PCT/FI2009/050506 filed on Jun. 12, 2009, which claims priority under 35 U.S.C. 119(a) to Patent Application No. 20080450 filed in the Finland on Aug. 1, 2008, all of which are hereby expressly incorporated by reference into the present application.

BACKGROUND OF THE INVETION

Field of the Invention

The present invention relates to a control arrangement of a transport system, and a method in connection with a transport system.

The power requirement of a transport system varies according to the loading and the control situation. For example, the power requirement during acceleration of the elevator system is transiently over double compared to the power required during even speed. In this case the current taken by the elevator from the supply network of the building also varies, and e.g. dimensioning of the fuses in the electricity supply of the building must be done according to the maximum supply current of the elevator. The elevator also returns some of the committed energy to the system during regenerative operation of the elevator motor. This energy returned to the power supply system is conventionally converted into heat in a separate power resistor or it is returned to the supply network.

Efforts have been made to compensate the fluctuations in the power taken from the supply network by adding temporary storages of energy to the power supply system of the elevator, which temporary storages supply a part of the transient power needed during heavy loading, and on the other hand receive the transient power of heavy loading returned to the power supply system during regenerative operation. When a temporary storage of energy is used for only leveling out the variation of peak power in the aforementioned manner, the mains electricity connection of the building must still be dimensioned for a relatively large power requirement.

Publication U.S. Pat. No. 6,742,630 B2 presents an arrangement wherein an energy storage comprising supercapacitors and/or electrochemical accumulators is connected to the intermediate circuit of the frequency converter of an elevator. According to the publication, electrical energy can be supplied from the energy storage for the use of the elevator motor for the whole travel time of the elevator.

The electrical energy storages of transport systems have conventionally been of very high capacitance. For example, the size of the energy storage needed in elevator systems increases as the travel height increases, especially if power is supplied from the energy storage for the whole heavy direction travel time of the elevator. These types of energy storages also considerably increase the costs of a transport system. Additionally, energy storages are in this case are of very large size in their mechanical dimensions also, in which case their placement as a part of the power supply system of transport system is difficult. The need for space is also a problem e.g. in so-called elevator systems without machine rooms, in which at least a part of the power supply system is disposed in the elevator hoistway.

SUMMARY OF THE INVENTION

The purpose of this invention is to solve the aforementioned problems as well as the problems disclosed in the description of the invention below. The invention presents a control arrangement of a transport system, by means of which the dimensioning of the power source of the transport system can be made smaller, and an energy storage of smaller capacitance than a prior-art one can in this case be used for making the dimensioning of the power source smaller.

In the control arrangement of a transport system according to the invention the transport system comprises: a motor for moving the transport appliance; a power supply circuit of the motor, said power supply circuit being connected between the motor and a power source that is limited ($P_{lim}$) in its dimensioning; and also an energy storage that is limited ($E_{lim}$) in its capacity fitted in connection with the power supply circuit of the motor, for supplying power between the energy storage and the power supply circuit of the motor. The control arrangement comprises: a determination of the charging status ($E_Q$) of the energy storage; a determination of the movement reference of the transport appliance; and also a control of the movement of the transport appliance as a response to the determined movement reference of the transport appliance. The movement reference of the transport appliance is determined on the basis of the amount of energy that can be discharged from the energy storage and/or on the basis of the amount of energy that can be charged into the energy storage as well as on the basis of the travel distance of the transport appliance. The power source is dimensioned such that the maximum permitted power to be processed is given the value ($P_{lim}$). The dimensioning can in this case be determined according to the fuse of the power source, the cross-sectional area of the cables, or the power endurance of some other connection component or protection component.

In one embodiment of the invention the control arrangement comprises a determination of the movement reference of the transport appliance on the basis of the amount of energy that can be discharged from the energy storage and/or on the basis of the amount of energy that can be charged into the energy storage as well as on the basis of the travel distance of the transport appliance. In this case the movement reference of the transport appliance is fitted to limit the movement of the transport appliance in its maximum value when the travel distance of the transport appliance exceeds the limit value set for travel distance.

In the method in connection with a transport system according to the invention: a motor is fitted to the transport system, for moving a transport appliance; a power supply circuit of the motor is connected between the motor and a power source that is limited ($P_{lim}$) in its dimensioning; an energy storage that is limited ($E_{lim}$) in its capacity is fitted in connection with the power supply circuit of the motor, for supplying power between the power supply circuit of the motor and the energy storage; a charging status ($E_Q$) of the energy storage is determined; a movement reference of the transport appliance is determined; the movement of the transport appliance is controlled as a response to the determined movement reference of the transport appliance; and also the movement reference of the transport appliance is determined on the basis of the amount of energy that can be discharged from the energy storage and/or on the basis of the amount of energy that can be charged into the energy storage as well as on the basis of the travel distance of the transport appliance.

In one embodiment of the invention the movement reference of the transport appliance is determined on the basis of the amount of energy that can be discharged from the energy storage and/or on the basis of the amount of energy that can be charged into the energy storage as well as on the basis of the travel distance of the transport appliance; a limit value is set for the travel distance of the transport appliance; and also the movement reference of the transport appliance is fitted to limit the movement of the transport appliance in its maximum value when the travel distance exceeds the aforementioned limit value.

In one embodiment of the invention power is supplied via the power supply circuit of the motor also to the other electrification of the transport system. In an elevator system, power can in this case be supplied e.g. to the electrification of the elevator hoistway, to the lighting of the elevator, and also to the power electronics or the brakes of the elevator.

The energy storage according to the invention can comprise a supercapacitor and/or an accumulator, e.g. a lithium-ion accumulator. The energy storage can also comprise e.g. a flywheel, a superconducting coil and/or a fuel cell. The energy storage can be connected directly to the power supply circuit of the motor or via a separate power transformer, such as an inverter or a DC/DC transformer. The power supply circuit of the motor can also comprise a power supply apparatus, with intermediate circuit, of the motor, such as a frequency converter. In this case the energy storage can be fitted directly between the positive and the negative intermediate circuit busbar of the power supply appliance with intermediate circuit of the motor. The power supply of the energy storage can also occur via a power controller connected between the energy storage and the intermediate circuit of the power supply apparatus.

The transport system referred to in the invention can be e.g. an elevator system, an escalator system, a travelator system, a positive drive elevator system, a crane system, a conveyor for conveying materials and raw materials, or a vehicle system. The term transport appliance refers to a functional part of a transport system, with which the object to be transported is moved.

The elevator system according to the invention can be provided with a counterweight or can be one without a counterweight.

The power source according to the invention can be e.g. an electricity network, a generator, a fuel cell, and/or a UPS power source. In this case the power source can also be a single-phase alternating-electricity source.

With the invention at least one of the following advantages, among others, is achieved:

As the movement reference of the transport appliance is determined on the basis of the amount of energy that can be discharged from the energy storage and/or on the basis of the amount of energy that can be charged into the energy storage as well as on the basis of the travel distance of the transport appliance, the transfer capacity of the transport appliance can be optimized taking into account the capacity limitations of the power source and of the energy storage. With very short travel distances, such as when the elevator drives short floor-to-floor runs in peak hours, the transfer capacity can be increased by means of the energy storage compared to what would be possible when using just a transport system power source that is of limited dimensioning for the power supply.

By means of the invention it is also possible to use an energy storage that is smaller in capacity than prior art, which reduces the costs of the power supply arrangement. In addition, the energy storage is in this case often also of smaller size in its mechanical dimensioning, and it can if necessary be fitted as a part of the mechanics of the power supply apparatus, such as the frequency converter, of the motor.

When the movement reference of the transport appliance is determined according to the invention, the movement of the transport appliance can be continuous in all control situations as well as with all loadings and with all travel distances.

According to the invention it is also possible to optimize the movement references of at least two such transport appliances whose power supply is fitted to occur via a common power supply circuit of the motor. In this case a common energy storage can be fitted to both in connection with the power supply circuit, and the movement references of the transport appliances can be determined on the basis of the amount of energy that can be discharged from the energy storage and/or on the basis of the amount of energy that can be charged into the energy storage, as well as on the basis of the travel distances of both transport appliances.

BRIEF DESCRIPTION OF THE DRAWINGS

In the following, the invention will be described in more detail by the aid of a few examples of its embodiments with reference to the attached drawings, wherein.

DETAILED DESCRIPTION OF THE PREFERRED EMBODIMENTS

Figure 1:
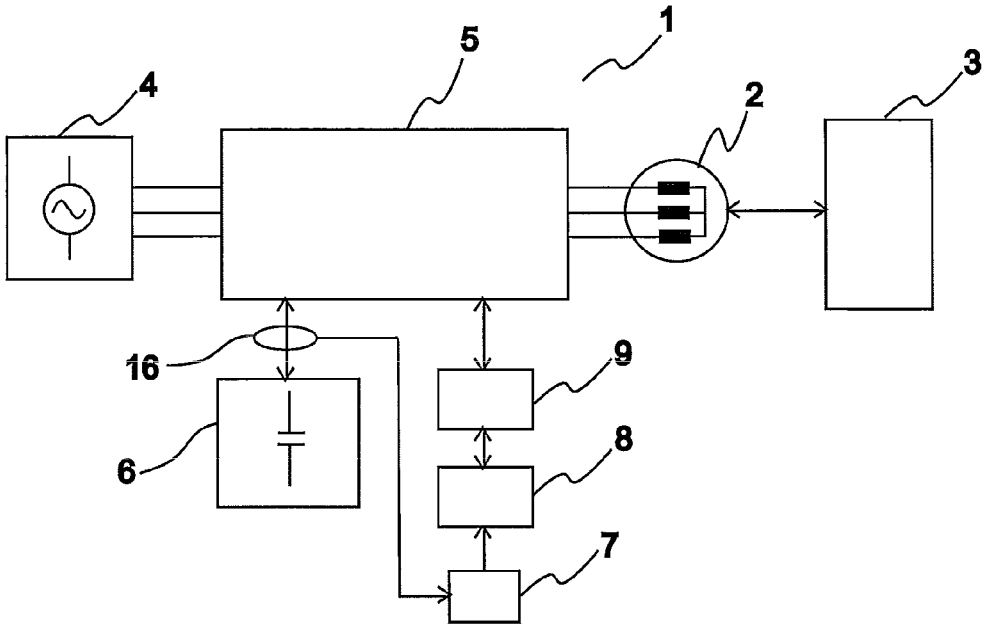
FIG. 1 presents a control arrangement of a transport system according to the invention

FIG. 1 presents a control arrangement according to the invention, in which power is supplied via the power supply circuit 5 of the motor between the motor 2 that moves the transport appliance 3 and the electricity network 4. The power supply circuit 5 comprises at least one controllable switch for controlling the power supply. In this case the control 9 of the movement of the transport appliance adjusts at least one electrical magnitude of the power supply circuit such that the transport appliance moves as a response to the movement reference 10 of the transport appliance.

An energy storage 6 that is limited ($E_{lim}$) in its capacity is also fitted in connection with the power supply circuit of the motor, for supplying power between the energy storage and the power supply circuit 5 of the motor. The energy storage 6 comprises a plurality of supercapacitors connected in series with each other.

Fuses are fitted to the interface of the electricity network 4, the current endurance of which fuses determines the maximum permitted value $P_{lim}$ of the power supply of the electricity network.

The supply power of the electricity network 4 is supplemented from the energy storage 6 in at least some drive situations. In this case the energy in the storage 6 is distributed for use as additional power for the remaining travel distance. On the other hand, in certain drive situations some of the energy returning from the transport appliance 3 in motor braking is supplied back to the electricity network 4, and some is charged into the energy storage 6.

The determination 8 of the movement reference of the transport appliance determines the movement reference 10 of the transport appliance on the basis of the amount of energy that can be discharged from the energy storage and/or on the basis of the amount of energy that can be charged into the energy storage as well as on the basis of the travel distance (11,11') of the transport appliance. The determination 7 of the charging status of the energy storage measures at least one electrical magnitude, such as voltage or current, that relates to the power supply of the energy storage 6 and determines on the basis of this the amount $E_Q$ of energy contained in the energy storage. The aforementioned amount of energy is also proportional to the amount of energy that can be discharged from the energy storage. The amount $E_{load}$ of energy that can be charged into the energy storage, on the other hand, is proportional to the difference between the capacity ($E_{lim}$) of the energy storage and the amount $E_Q$ of energy contained in the energy storage.

$$E_{load}=E_{lim}-E_Q \tag{1}$$

When the transport appliance moves essentially vertically in the heavy direction, the force effect of the motor that moves the transport appliance is in the direction of movement of the transport appliance. In this case the largest average speed v of the transport appliance during the travel distance used as the determination criterion of the movement reference 10 of the transport appliance is almost proportional to the dimensioning ($P_{lim}$) of the electricity network 4, to the travel distance s, to the sum m*g of gravity exerted on the transport appliance and on the load, and also to the amount $E_Q$ of energy contained in the energy storage:

$$v=\frac{P_{lim}*s}{m*g*s-E_Q} \tag{2}$$

When, on the other hand, the transport appliance moves essentially vertically in the light direction, the force effect of the motor that moves the transport appliance is in the opposite direction to the movement of the transport appliance. In this case the largest average speed v of the transport appliance during motor braking used as the determination criterion of the movement reference 10 of the transport appliance is almost proportional to the dimensioning ($P_{lim}$) of the electricity network 4, to the travel distance s, to the sum m*g of gravity exerted on the transport appliance and on the load, and also to the amount $E_{load}$ of energy that can be charged into the energy storage:

$$v=\frac{P_{lim}*s}{m*g*s-E_{load}} \tag{3}$$

Figure 6:
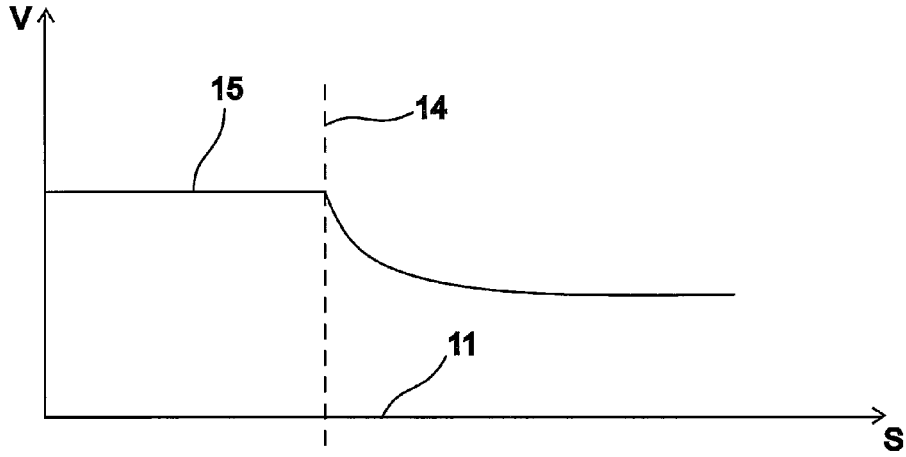
FIG. 6 presents some selection criteria according to the invention for the maximum permitted average speed of the transport appliance.

When analyzing the equations (2) and (3) it can be seen that the ratio of the travel distance s of the transport appliance to the largest average speed of the transport appliance that is used as the determination criterion of the movement reference of the transport appliance can roughly define the graph according to FIG. 6. The determined limit value 14 of the travel distance is limited by the maximum possible average speed v on short runs according to the maximum value of the average speed permitted by dimensionings of the power supply apparatuses, such as the power supply circuit 5 of the motor and the motor 2, of the transport appliance. When, on the other hand, the length of the travel distance exceeds the aforementioned limit value 14, the average speed v and at the same time the movement reference of the transport appliance is limited according to FIG. 6.

Figure 5:
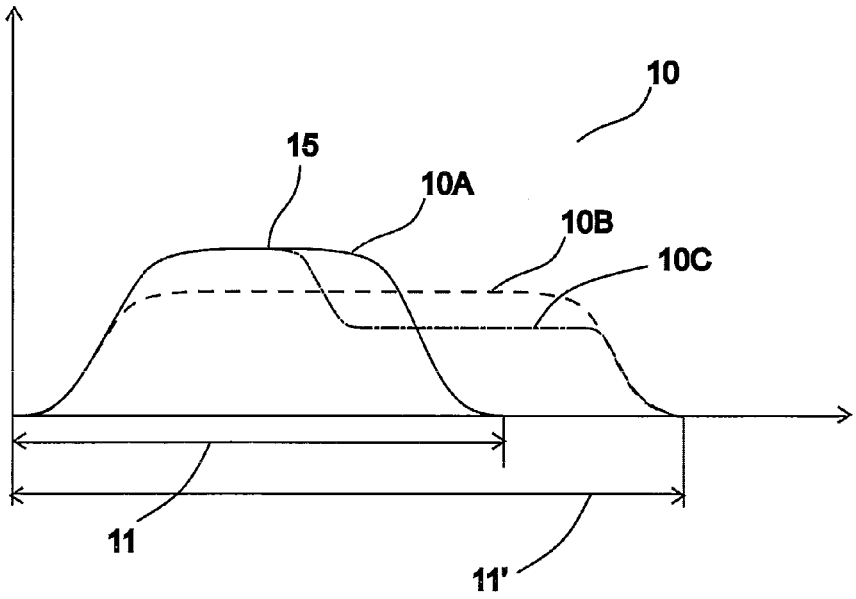
FIG. 5 presents some movement references of the transport system according to the invention

FIG. 5 presents, by way of example, the graphs 10; 10A, 10B, 10C; of the speed reference of the transport appliance when the length 11, 11' of the travel distance of the transport appliance varies. The graph 10A of the speed reference is determined in a situation in which the length 11 of the travel distance of the transport appliance is below the set limit value 14 for travel distance. In this case the speed reference of the transport appliance is determined to correspond to the maximum value 15 of speed. The graph 10B of the speed reference, on the other hand, is fitted to limit the speed of the transport appliance in its maximum value 15, because the travel distance 11' of the transport appliance in this case exceeds the aforementioned limit value 14 for travel distance. FIG. 5 presents also a graph 10C of a second speed reference in a situation where the travel distance of the transport appliance exceeds the limit value 14. In this case the speed reference of the transport appliance varies according to the figure during the travel distance.

Figure 2:
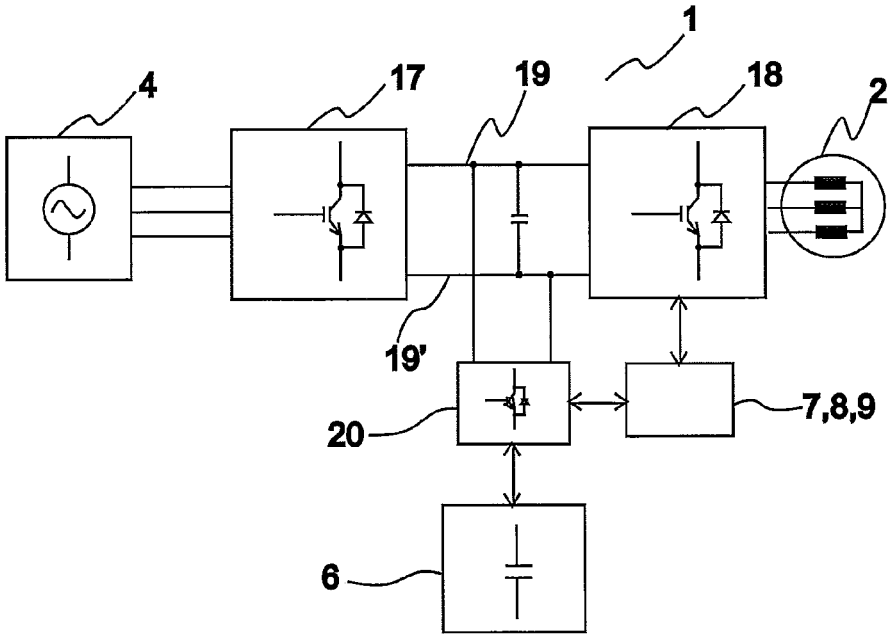
FIG. 2 presents a second control arrangement of a transport system according to the invention

FIG. 2 presents one control arrangement according to the invention, in which a frequency converter is fitted to the power supply circuit of the motor, for supplying power between the electricity network 4 and the motor 2 that moves the transport appliance. The frequency converter comprises a network bridge 17 connected to the phases of the electricity network and a motor bridge 18 connected to the phases of the motor. The network bridge 17 and the motor bridge 18 are connected to each other with an intermediate circuit 19, 19'. An energy storage 6 of limited capacity is connected via the power controller 20 of the energy storage to the intermediate circuit 19, 19', for supplying power between the frequency converter and the energy storage 6.

The network bridge 17, the motor bridge 18 and the power controller 20 of the energy storage comprise controllable solid-state switches, such as IGBT transistors, for controlling the power supply. The power controller 20 of the energy storage measures the voltage and the current of the energy storage, and controls the power supply of the energy storage on the basis of this. The determination 7 of the charging status of the energy storage determines, on the basis of the measuring data of voltage and current, the amount of energy that can be discharged from the energy storage and/or the amount of energy that can be charged into the energy storage. The determination 8 of the movement reference of the transport appliance determines the movement reference 10 on the basis of the amount of energy that can be discharged from the energy storage and/or on the basis of the amount of energy that can be charged into the energy storage as well as on the basis of the travel distance (11,11') of the transport appliance. The determination of the movement reference occurs according to the embodiment of FIG. 1 and also according to FIGS. 5 and 6.

Figure 3:
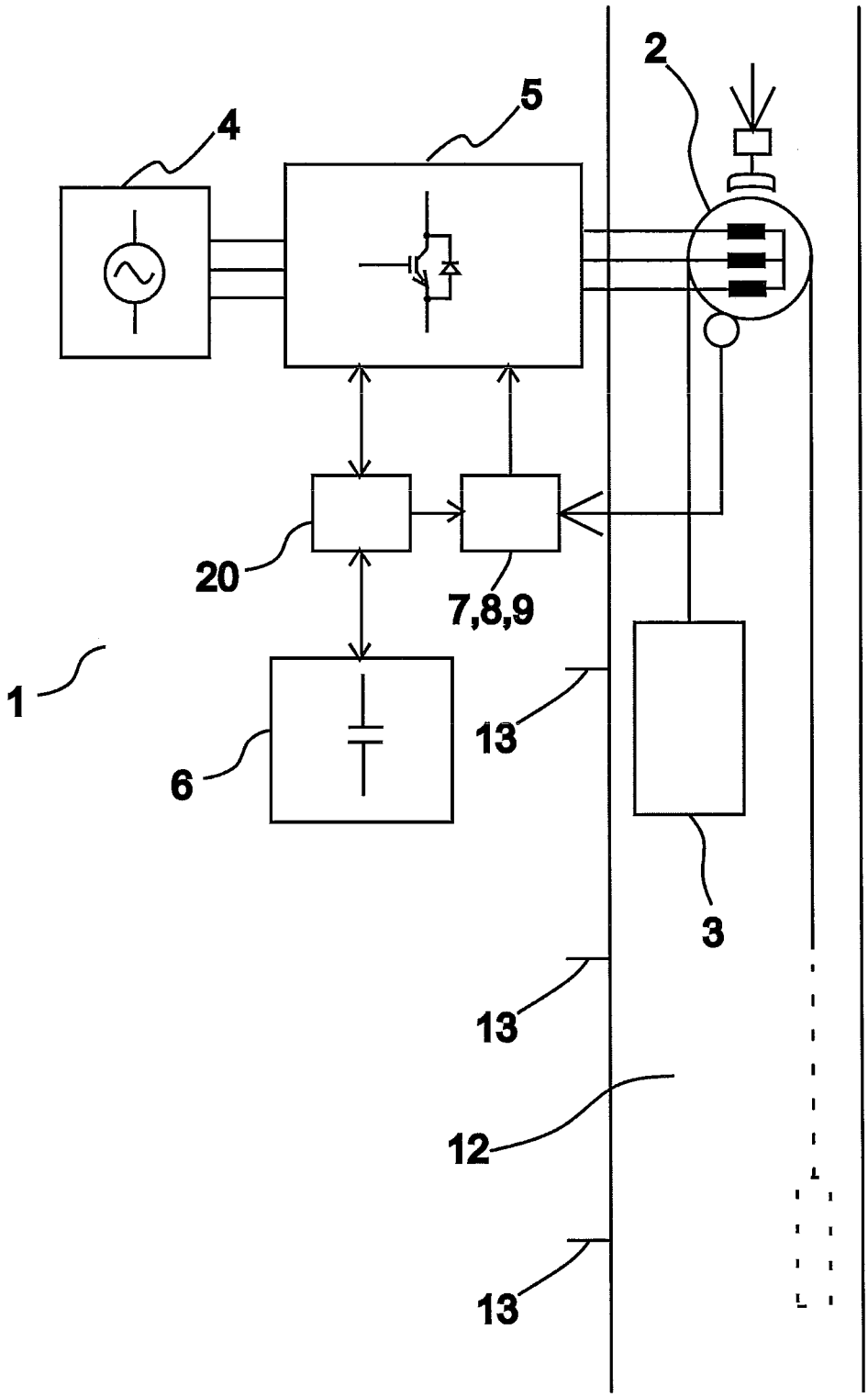
FIG. 3 presents an elevator system into which a control arrangement according to the invention is fitted
Figure 4:
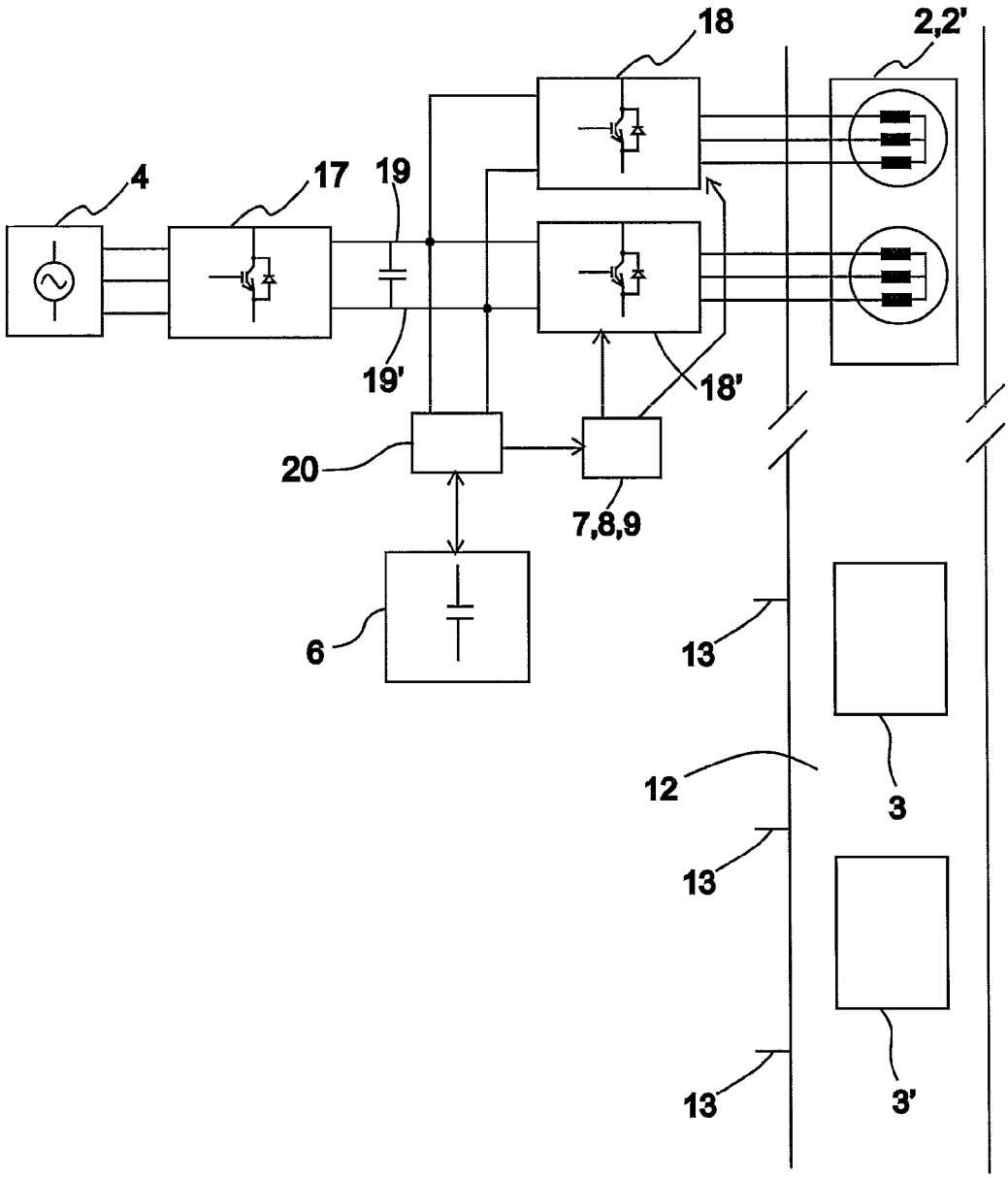
FIG. 4 presents a second elevator system into which a control arrangement according to the invention is fitted

FIGS. 3 and 4 present two different elevator systems, to which a control arrangement according to the invention is fitted.

In the elevator system according to FIG. 3, the elevator car is fitted to move in the elevator hoistway 12 essentially in the vertical direction between the floor landings 13 according to the landing calls. In one embodiment of the invention the movement reference of the elevator car is in this case determined on the basis of a destination call of the elevator car. The destination call comprises information about the starting points and stopping points of the elevator, in which case the travel distance 11, 11' of the elevator can be determined on the basis of the destination call. In this case also the movement reference 10 of the elevator car can be determined on the basis of destination call.

The movement reference 10 of the elevator car is determined also on the basis of the loading of the elevator as well as on the basis of the drive direction of the elevator car. When driving in the heavy direction the motor 2 that moves the elevator car receives energy, and when driving in the light direction energy returns to the power supply circuit 5 of the motor in motor braking. The power flow between the motor and the power supply circuit 5 of the motor decreases as the loading decreases. In this case when the loading decreases also the greatest possible travel distance of the elevator car at maximum speed 11 increases. The loading of the elevator can be determined e.g. by means of a load weighing device of the elevator car. The loading can be resolved also e.g. on the basis of the determination of the current of the motor 2 that moves the elevator car 3.

The power supply circuit 5 of the motor comprises a frequency converter, in which the power control occurs by means of controllable IGBT transistors. An energy storage 6 that is limited in its capacity is fitted in connection with the DC intermediate circuit of the frequency converter. The energy storage 6 is fitted, on the one hand, to give up energy for the operating need of the motor 2 that moves the elevator car 3 and, on the other hand, to receive energy released from operation of the motor that moves the elevator car. Additionally, energy can be supplied to the energy storage from the power source 4 according to need during a standstill of the elevator system.

The elevator system according to FIG. 4 differs from that presented in FIG. 3 in that the elevator system comprises two elevator cars 3, 3', which are fitted into the same elevator hoistway 12. Likewise the hoisting machine of the elevator system comprises a first motor 2 that moves the first elevator car 3 as well as a second motor 2' that moves the second elevator car 3'. The motors 2, 2' are connected to a common power supply circuit 5. A frequency converter, which comprises two motor bridges 18, 18' and one network bridge 17, is used for the power control. The network bridge and both the motor bridges are connected to a common DC intermediate circuit 19, 19'. The first motor bridge 18 is connected to the first motor 2, and the second motor bridge 18' is connected to the second motor 2'. An energy storage 6 of limited ($E_{lim}$) capacity is connected to the common intermediate circuit 19, 19'. The movement references of the elevator cars 3, 3' are determined on the basis of the amount of energy that can be discharged from the energy storage and/or on the basis of the amount of energy that can be charged into the energy storage as well as on the basis of the travel distances of both transport appliances. In this case when the second elevator car moves in the light direction, energy is returned to the common intermediate circuit 19, 19', from where it can if necessary be transferred for use by the elevator car moving in the heavy direction, in which case the amount of energy discharged from the energy storage and/or charged into the energy storage decreases. In this case also the maximum travel distance 11 of the maximum speed of the elevator car can be increased.

The invention is not limited solely to the embodiments described above, but instead many variations are possible within the scope of the inventive concept defined by the claims below.

The movement of the transport appliance in the vertical direction is described above. In this case the force effect opposing the movement of the transport appliance presented in equations (2) and (3) is often formed essentially from the force of gravity m*g. It is, however, obvious to a person skilled in the art that when the movement of the transport appliance comprises a component also in the horizontal direction, the force effect opposing the movement of the transport appliance can be formed essentially also from friction force, in which case this effect must be added in connection with the gravity term, or the gravity term must be replaced with the frictional force. In the same way also e.g. the effect of air resistance opposing the movement must be taken into account when the air resistance of the transport appliance substantially increases.

It is obvious to a person skilled in the art that when the travel distance shortens, the relative run-time proportion of the acceleration and deceleration of the transport appliance increases, in which case the maximum speed of the transport appliance must be increased in order to achieve the same average speed.

It is also obvious to the skilled person that movement of the transport appliance can also refer to the acceleration and/or the travel distance of the transport appliance, in addition to the speed of the transport appliance.

The invention claimed is:

1. A control arrangement of a transport system, which transport system comprises:

a motor for moving a transport appliance;

a power supply circuit of the motor connected between the motor and a power source that is limited ($P_{lim}$) in its dimensioning;

an energy storage, limited ($E_{lim}$) in its capacity, fitted in connection with the power supply circuit of the motor, for supplying power between the energy storage and the power supply circuit of the motor;

a determination of a charging status ($E_Q$) of the energy storage;

a determination of a movement reference of the transport appliance; and a control of the movement of the transport appliance as a response to the movement reference of the transport appliance, wherein the movement reference of the transport appliance is determined based on a travel distance of the transport appliance and an amount of energy that can be discharged from the energy storage when the transport appliance moves vertically in a heavy direction and is determined based on the travel distance of the transport appliance and an amount of energy that can be charged into the energy storage when the transport appliance moves vertically in a light direction that is opposite to the heavy direction.

2. The control arrangement according to claim 1, wherein the movement reference of the transport appliance is determined further based on a loading and a drive direction of the transport appliance.

3. The control arrangement according to claim 2, wherein the transport appliance is fitted to move in such a limited area in a horizontal direction and/or a vertical direction, in which at least one distance between starting points and stopping points of the transport appliance is defined in advance, and the movement reference of the transport appliance is in this case determined based on a destination call of the transport appliance.

4. The control arrangement according to claim 2, wherein a limit value is set for the travel distance of the transport appliance, and the movement reference for the transport appliance is limited to a maximum value when the travel distance exceeds the limit value.

5. The control arrangement according to claim 2, wherein the energy storage is fitted to give up energy for operation need of the motor that moves the transport appliance and to receive the energy released from operation of the motor that moves the transport appliance as well as the energy supplied from the power source during a standstill of the transport system.

6. The control arrangement according to claim 1, wherein the transport appliance is fitted to move in such a limited area in a horizontal direction and/or a vertical direction, in which at least one distance between starting points and stopping points of the transport appliance is defined in advance, and the movement reference of the transport appliance is in this case determined based on a destination call of the transport appliance.

7. The control arrangement according to claim 6, wherein a limit value is set for the travel distance of the transport appliance, and the movement reference for the transport appliance is limited to a maximum value when the travel distance exceeds the limit value.

8. The control arrangement according to claim 6, wherein the energy storage is fitted to give up energy for operation need of the motor that moves the transport appliance and to receive the energy released from operation of the motor that moves the transport appliance as well as the energy supplied from the power source during a standstill of the transport system.

9. The control arrangement according to claim 1, wherein the energy storage is fitted to give up energy for operation need of the motor that moves the transport appliance and to receive the energy released from operation of the motor that moves the transport appliance as well as the energy supplied from the power source during a standstill of the transport system.

10. A control arrangement of a transport system, which transport system comprises:

a motor for moving a transport appliance;

a power supply circuit of the motor connected between the motor and a power source that is limited ($P_{lim}$) in its dimensioning;

an energy storage, limited ($E_{lim}$) in its capacity, fitted in connection with the power supply circuit of the motor, for supplying power between the energy storage and the power supply circuit of the motor;

a determination of a charging status ($E_Q$) of the energy storage;

a determination of a movement reference of the transport appliance; and a control of the movement of the transport appliance as a response to the movement reference of the transport appliance, wherein the movement reference of the transport appliance is determined based on a travel distance of the transport appliance and at least one of an amount of energy that can be discharged from the energy storage and an amount of energy that can be charged into the energy storage, and wherein a limit value is set for the travel distance of the transport appliance, and the movement reference for the transport appliance is limited to a maximum value when the travel distance exceeds the limit value.

11. The control arrangement according to claim 10, wherein the energy storage is fitted to give up energy for operation need of the motor that moves the transport appliance and to receive the energy released from operation of the motor that moves the transport appliance as well as the energy supplied from the power source during a standstill of the transport system.

12. A method in connection with a transport system, said method comprising the steps of:

fitting a motor to the transport system for moving a transport appliance;

connecting a power supply circuit of the motor between the motor and a power source that is limited ($P_{lim}$) in its dimensioning;

fitting an energy storage that is limited ($E_{lim}$) in its capacity in connection with the power supply circuit of the motor, for supplying power between the power supply circuit of the motor and the energy storage;

determining a charging status ($E_Q$) of the energy storage;

determining a movement reference of the transport appliance;

controlling the motion of the transport appliance as a response to the movement reference of the transport appliance; and wherein the step of determining the movement reference of the transport appliance is based on a travel distance of the transport appliance and an amount of energy that can be discharged from the energy storage when the transport appliance moves vertically in a heavy direction and is determined based on the travel distance of the transport appliance and an amount of energy that can be charged into the energy storage when the transport appliance moves vertically in a light direction that is opposite to the heavy direction.

13. The method according to claim 12, wherein the step of determining the movement reference of the transport appliance is further based on a loading and a travel direction of the transport appliance.

14. The method according to claim 13, further comprising the steps of:

determining a limit value for the travel distance of the transport appliance; and limiting the movement reference of the transport appliance to a maximum value when the travel distance exceeds the limit value.

15. A method in connection with a transport system, said method comprising the steps of:

fitting a motor to the transport system for moving a transport appliance;

connecting a power supply circuit of the motor between the motor and a power source that is limited ($P_{lim}$) in its dimensioning;

fitting an energy storage that is limited ($E_{lim}$) in its capacity in conection with the power supply circuit of the motor, for supplying power between the power supply circuit of the motor and the energy storage;

determining a charging status ($E_Q$) of the energy storage;

determining a movement reference of the transport appliance;

controlling the motion of the transport appliance as a response to the movement reference of the transport appliance;

determining a limit value for the travel distance of the transport appliance; and limiting the movement reference of the transport appliance to a maximum value when the travel distance exceeds the limit value, wherein the step of determining the movement reference of the transport appliance is based on a travel distance of the transport appliance and at least one of an amount of energy that can be discharged from the energy storage and an amount of energy that can be charged into the energy storage.

* * * * *